United States Patent [19]

Sixsmith et al.

[11] 4,334,821

[45] Jun. 15, 1982

[54] REGENERATIVE ROTODYNAMIC MACHINES

[75] Inventors: Herbert Sixsmith, Oxford; Keith Thurlow, Nr. Ipswich; Geoffrey K. Soar, Ipswich; James W. Burton, Ipswich, all of England

[73] Assignee: Compair Industrial Ltd., Ipswich, England

[21] Appl. No.: 97,956

[22] Filed: Nov. 28, 1979

[30] Foreign Application Priority Data

Nov. 28, 1978 [GB] United Kingdom ..... 46419/78

[51] Int. Cl.[3] ..... F04B 5/00

[52] U.S. Cl. ..... 415/53 T; 415/198.2; 415/213 T

[58] Field of Search ..... 415/53 T, 198.2, 213 T

[56] References Cited

U.S. PATENT DOCUMENTS

| | | | |
|---|---|---|---|
| 1,619,285 | 3/1927 | Burks | 415/213 T |
| 1,689,579 | 10/1928 | Burks | 415/198.2 |
| 1,973,669 | 9/1939 | Spoor | 415/53 T |
| 3,782,850 | 1/1974 | Eglio et al. | 415/53 T |

FOREIGN PATENT DOCUMENTS 2612118 10/1976 Fed. Rep. of Germany .... 415/53 T

*Primary Examiner*—L. Casaregola

*Attorney, Agent, or Firm*—Ira C. Edell

[57] ABSTRACT

In a regenerative rotodynamic compressor, a portion of a disc-like impeller adjacent the impeller periphery extends radially through an annular chamber in the compressor casing concentric with the impeller, thereby dividing said chamber into two annular side channels, one on each side of the impeller. The portion of the impeller lying in the annular chamber has scooped out annular cavities or recesses in its sides in which are disposed rings of aerodynamic blades, and fluid flow passing around the annular chamber from an inlet to an outlet is caused to circulate repeatedly, flowing radially outward through the blading in the impeller cavities and radially inward in the annular side channels alongside the impeller outside the impeller cavities. The aerodynamic blades are designed so that the angle between the entry and exit flows of each blade is greater than 90°.

7 Claims, 3 Drawing Figures

REGENERATIVE ROTODYNAMIC MACHINES

Figure 1:
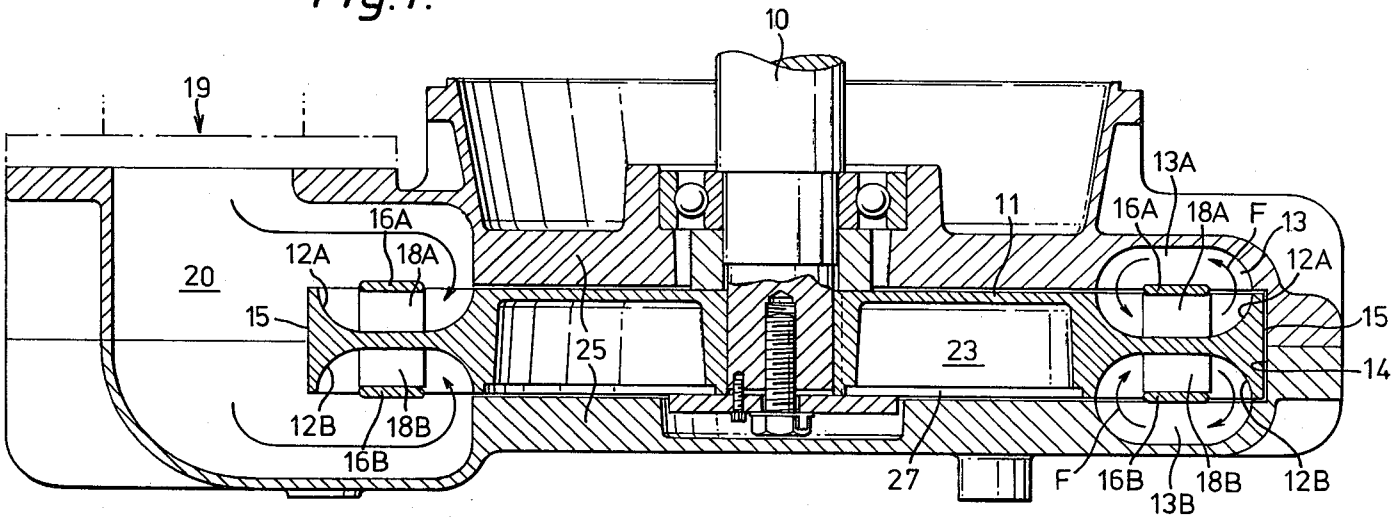

This invention relates to regenerative rotodynamic machines, and more especially to regenerative pumps and compressors.

A regenerative or peripheral pump is a rotodynamic machine which permits a head equivalent to that of several centrifugal stages to be obtained from a single rotor with comparable tip speeds. The impeller can take the form of a disc with a set of vanes projecting axially at each side near the disc periphery. Around the greater portion of the periphery the vanes project into an annular channel of which the cross sectional area is greater than that of the impeller vanes. At one sector between the inlet and discharge the annular channel is reduced to a close running clearance around the impeller. This sector is called the stripper seal and its function is to separate the inlet and discharge ports, thereby forcing the fluid out through the discharge port. The stripper allows only the fluid between the impeller vanes to pass through to the inlet.

The advantage of pumps of this type lies in the generation of a high head at low flow rates. They have a very low specific speed. Although their efficiency is not very high, being usually less than 50%, pumps of this type have found many applications in industry where it is preferred to use rotodynamic pumps in place of positive displacement pumps for duties requiring a high head at low flow rates. Their simplicity, and the absence of problems due to lubrication and wear, give advantages over positive displacement pumps, despite the lower efficiency.

The regenerative pump has been adapted for the compression of gas. The advantage lies in the low specific speed giving a high pressure ratio together with a low flow rate for a given size of machine. Further advantages are oil free operation and freedom from stall or surge instability.

In such a compressor, the gas follows a helical path through the annular channel and passes through the vanes a number of times in its peripheral path from the inlet port to the discharge port. Each passage through the vanes may be regarded as a stage of compression and thus the equivalent of several stages of compression can be obtained from a single impeller. This pumping process, however, cannot be considered as efficient. The fluid between the vanes is thrown out and across the annular channel and violent mixing occurs, the angular momentum acquired by the fluid in its passage between the vanes being transferred to the fluid in the annular channel. The mixing process is accompanied by the production of a great deal of turbulence and this implies an undesirable waste of power.

Several theories of the fluid-dynamic mechanism of a regenerative pump have been published. These theories have been reviewed and compared by Senoo (A.S.M.E. Trans. Vol. 78, 1956, pp. 1091–1102). Differences occur in the assumptions made, but in principle the various theories appear to be compatible. Senoo and Iversen (A.S.M.E. Trans. Vol. 77, 1955, pp 19–28) consider turbulent friction between the moving impeller and the fluid as the primary force causing the pumping action. Wilson, Santalo and Oelrich (A.S.M.E. Trans. Vol. 77, 1955, pp 1303–1316) regard the mechanism as based on a circulatory flow between the impeller and the fluid in the casing with an exchange of momentum between the fluid passing through the impeller and the fluid in the casing.

More recently, compressors with considerably better efficiency have been proposed in which the conventional radial vanes are replaced by aerodynamic blading. The annular channel is provided with a core to assist in guiding the fluid so that it circulates through the blading with a minimum of loss. The core also acts as a shroud closely surrounding the blades at their tips to reduce losses due to the formation of vortices at the tips of the blades. Such an arrangement is described, for instance, in British Patent Specification No. 1,237,363.

It is an object of this invention to achieve further important improvements in regenerative rotodynamic machines having aerodynamic blading.

According to the present invention, there is provided a regenerative rotodynamic machine having an impeller with a ring of aerodynamic blades rotating in an annular channel in the casing, the angle between the entry and exit flows of each aerodynamic blade being greater than 90°.

Whereas in prior regenerative machines with aerodynamic blading the angles between the entry and exit flows have been less than 90°, we have discovered that there is a considerable and hitherto unsuspected advantage in efficiency in increasing the angle to well above 90°.

In the preferred embodiment, an annular chamber in the machine casing is divided by the impeller into two annular side channels, one on each side of the impeller, and the impeller has rings of aerodynamic blading disposed therein, on both sides of its peripheral region. Each curved surface of each aerodynamic blade is formed from one or more circular arcs.

Figure 2:
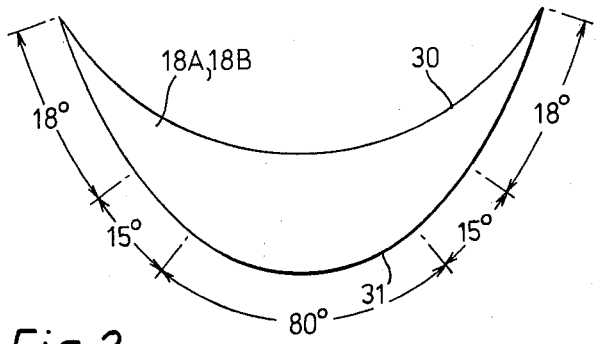
Figure 3:
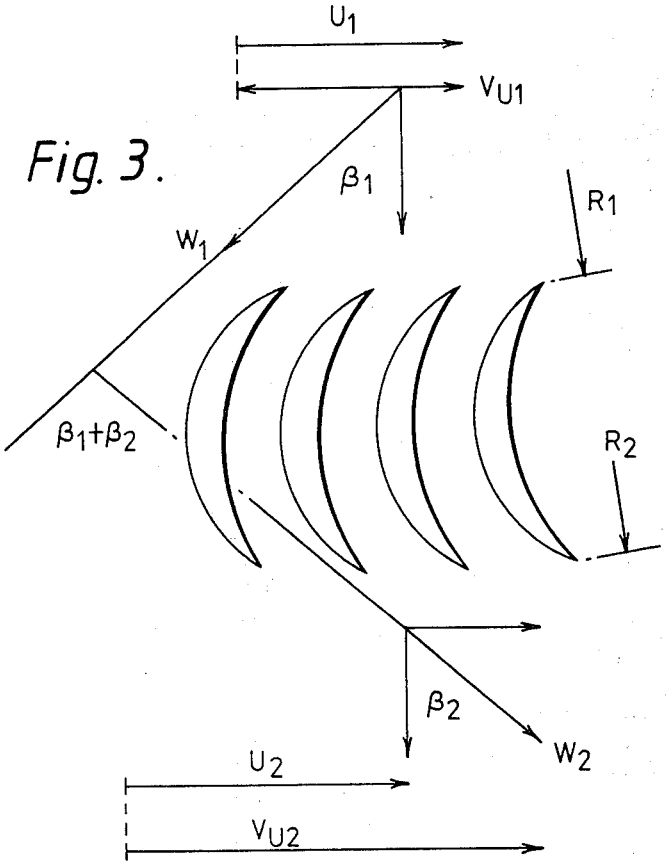

Arrangements of compressor in accordance with the invention will now be described, by way of example, with reference to the accompanying drawings, in which:

FIG. 1 is a diagrammatic cross-section of a regenerative compressor according to the invention, FIG. 2 is a diagram of the aerodynamic blade profile, and FIG. 3 is a diagrammatic representation of the blade velocities and flow angles.

Referring firstly to FIG. 1, this shows diagrammatically a simple single impeller regenerative compressor according to the invention. The impeller 11 housed in a split casing 25 is driven by a shaft 10 and consists of a disc with aerodynamic blades 18A, 18B provided within scooped out regions 12A, 12B at each side of the disc just radially inward of the disc periphery. As seen from the drawings, each aerodynamic blade is curved in a radial plane at right angles to the impeller axis and has a concave inner surface and a convex outer surface of greater curvature than the inner surface. The bladed margin of the impeller projects into an annular chamber 13 in the compressor casing 25 which is wider than the impeller and has at its outer periphery an inward-facing cylindrical surface 14 which is closely approached by the cylindrical peripheral surface 15 of the impeller 11, thereby dividing the chamber 13 into two separated side channels 13A, 13B, each of roughly oval cross-section, that are located on opposite sides of the impeller disc 11 and are each defined partly by the wall of the chamber 13 and partly by the contour of the respective scooped out side portion 12A or 12B of the impeller 11 that contains the blades 18A or 18B. The blades extend approximately half-way across the respective side channel 13A, 13B and are designed to turn the fluid through an angle $B_1+B_2$ (FIG. 3) of well in excess of 90°, in a radial plane at right angles to the impeller axis. As the fluid flows radially outward through the blading, a circulation is set up in each side channel 13A, 13B as indicated by the arrows F. Each annular side channel has a central core 16A, 16B to assist in guiding the fluid so that it circulates through the blading with a minimum of loss. Each core 16A, 16B is in the form of a shroud ring placed against the blade tips to eliminate loss due to formation of vortices at the tips of the blades.

The fluid enters the annular chamber 13 through a port 19 in the wall of the casing 25 which leads to an inlet chamber 20 communicating with both of the channels 13A, 13B at their outer peripheries. The fluid leaves the annular channels 13A, 13B through an outlet (not shown) which is followed by a conical diffuser to obtain pressure recovery. Between the inlet and outlet, the stripper seal (not shown) is formed by shaping the interior of the casing walls so that they approach closely to the sides of the impeller all the way out to its periphery 15. Alternatively, the stripper seal can be formed by the addition of a completely separate stripper element.

Radially inward of the scooped cavities 12A, 12B and blading 18A, 18B, the impeller 11 is formed as an annular dish, with a hollow interior 23 closed by an annular plate 27.

Between the inlet and outlet ports, the fluid being compressed passes a number of times through the blading 18A, 18B. During each passage a quantity of energy is transferred from the impeller to the fluid. The rate of flow through the blading is self-adjusting in the sense that the velocity through the blade channels tends to increase until the rate of energy transfer reaches the value needed to generate the pressure difference between the inlet and outlet ports. An increase in the pressure difference causes corresponding increases in both the number of passages through the blading and the energy transferred at each passage. The rate of energy transfer tends to vary as the square of the velocity relative to the blades. By equating the power transferred from the blading to the fluid with the power needed to generate the pressure difference across the inlet and outlet ports, the flow velocities in the annular channels 13A, 13B can be estimated. This information serves as a useful guide towards the optimum design of the blading.

Referring to FIG. 3, it is seen that the fluid enters and leaves the blading with relative velocities $W_1$ and $W_2$ and with inlet and outlet fluid angles of $\beta_1$ and $\beta_2$. If $V_{U1}$ and $V_{U2}$ are, respectively, the peripheral components of the absolute velocities of the fluid at the leading and trailing edges of the blading, and $U_1$ and $U_2$ are the peripheral velocities of the leading and trailing edges, then:

$$V_{U1}=U_1-W_1 \sin \beta_1$$

$$V_{U2}=U_2+W_2 \sin \beta_2$$

The peripheral or forward component of velocity of the gas on leaving the blades is greater than the blade velocity. As soon as the gas emerges from the blades, it comes under the influence of the peripheral pressure gradient and during its transverse passage around the annular channel its peripheral velocity is progressively reduced until it re-enters the blading to receive another impulse. As seen in FIG. 2, for ease of manufacture the surfaces of the aerodynamic blades 12A, 12B are formed of successions of circular arcs. In the example illustrated, the inner surface 30 of the blade is formed as a single arc while the outer surface 31 is formed as a central 80° arc flanked by two 15° arcs and then two 18° arcs. This gives the angle $\beta_1+\beta_2$ (FIG. 3) a value greater than 90°.

Machines according to the invention are balanced and vibration free and, being comparatively inexpensive to build, provide a quieter alternative to the Roots blower. Existing regenerative compressors are equally smooth running but not so efficient. Thus, such prior machines give a maximum of 8 p.s.i. in one stage whereas machines according to the invention will give 10 p.s.i. and upwards, and also can be employed to pull a vacuum.

We claim:

1. A regenerative rotodynamic machine comprising a casing, a rotor mounted to rotate within the casing and having at least one ring of blades thereon concentric with the axis of rotation, said blades rotating in an annular chamber in the casing that is likewise concentric with the axis of rotation, the annular chamber having a dimension in the radial direction greater than the radial extent of the blades and providing a channel alongside the blades in which fluid passing through the blades can recirculate, and wherein the blades are curved and profiled aerodynamic blades each having a concave inner surface which leads in the direction of rotation of the blades, and a convex outer surface which trails in the direction of rotation, the curvatures being chosen such that in operation the angle $(\beta_1+\beta_2)$ between the entry and exit flows of each aerodynamic blade, in the plane containing the curvature of the blade, is greater than 90°.

2. A machine according to claim 1, wherein a shroud ring is disposed adjacent to and coextensive with the blade tips of the ring of aerodynamic blades, the shroud ring constituting a core within the annular chamber around which the fluid circulates.

3. A machine according to claims 1 or 2, wherein the annular chamber in the machine casing is divided by the rotor into two annular side channels, one on each side of the rotor, and the rotor bears two rings of curved aerodynamic blades disposed in respective cavities or recesses in opposite sides of the rotor.

4. A machine according to claims 1 or 2, wherein the outer peripheral surface of the rotor is in close running clearance with an inward facing outer peripheral wall of the casing.

5. A machine according to claims 1 or 2, wherein each curved surface of each aerodynamic blade is formed from at least one circular arc.

6. A regenerative rotodynamic machine comprising a casing, a rotor mounted to rotate within the casing about an axis of rotation and having at least one ring of blades thereon concentric with the axis of rotation, said blades rotating in an annular chamber in the casing that is likewise concentric with the axis of rotation, the annular chamber having a dimension in the radial direction greater than the radial extent of the blades and providing a channel alongside the blades in which fluid passing through the blades can recirculate, and wherein each blade includes profiled aerodynamic surface means for directing exit flow from said blade at an angle which is greater than 90° relative to the entry flow of said blade for a prescribed operating rotational speed of said rotor.

7. the machine according to claim 11, wherein said surface means includes a concave inner surface which leads in the direction of rotation of the blades, and a convex outer surface which trails in the direction of rotation of the blades, and wherein said angle resides in a plane containing the curvature of the blade.

* * * * *